United States Patent [19]

Schossow

[11] 4,236,443

[45] Dec. 2, 1980

[54] CHIMNEY STACK EXHAUST UNIT

[76] Inventor: George W. Schossow, 2316 Lilac La., White Bear Lake, Minn. 55110

[21] Appl. No.: 64,185

[22] Filed: Aug. 6, 1979

Related U.S. Application Data

[63] Continuation of Ser. No. 894,726, Apr. 10, 1978, abandoned.

[51] Int. Cl.[3] ..... E04F 17/02

[52] U.S. Cl. ..... 98/58; 110/184; 415/116; 417/366; 417/371

[58] Field of Search ..... 417/366, 368, 369, 371; 98/58, 60; 110/184; 126/85 B; 415/98, 102, 116

[56] References Cited

U.S. PATENT DOCUMENTS

| | | | |
|---|---|---|---|
| 3,170,621 | 2/1965 | Morrison | 417/368 |
| 3,211,080 | 10/1965 | Rader | 98/58 |
| 3,499,774 | 8/1965 | Lowell | 417/366 |
| 3,592,122 | 7/1971 | Hughes | 98/58 X |
| 3,841,208 | 10/1974 | Knox | 98/58 |
| 3,874,363 | 4/1975 | Biedenbender et al. | 98/58 X |

*Primary Examiner*—Albert J. Makay
*Assistant Examiner*—William E. Tapolcai, Jr.
*Attorney, Agent, or Firm*—Merchant, Gould, Smith, Edell, Welter & Schmidt

[57] ABSTRACT

A chimney stack exhaust treatment unit and an improved exhaust gas treatment system utilizing such a unit are disclosed. The unit comprises a generally spherical outer housing which fits over the mouth of a caustic-resistant chimney pipe and encloses a horizontally mounted squirrel cage fan which is driven by an electric motor situated above it. The fan is situated directly above the chimney mouth so that when it is rotated, exhaust gases are drawn up through the chimney and swirled around the inner walls of the outer housing. Exhaust ports near the top of the housing provide an exit for treated gas. An inner housing encloses a fan motor, isolating it from the interior of the outer sphere. A conduit connects an opening in the outer sphere with an opening in the inner housing, and the inner housing includes a mouth directly above the fan, whereby rotation of the fan also draws outside air through the inner housing to cool the motor.

8 Claims, 2 Drawing Figures

CHIMNEY STACK EXHAUST UNIT

This is a continuation of application Ser. No. 894,726, filed Apr. 10, 1978, now abandoned.

BACKGROUND OF THE INVENTION

Field of the Invention

This invention relates generally to the field of energy retrieval and exhaust gas treatment systems. More specifically, this invention relates to chimney stack exhaust fan units.

Description of the Prior Art

In my co-pending patent application, Ser. No. 798,567, entitled "HEAT EXCHANGER," I disclose a system for preheating outside air to be used for combustion purposes in home heating systems and commercial, combustion-type power plants. The heat exchanger in that system comprises a plurality of vertical tubes carrying hot combustion gases from a combustion chamber to a chimney stack. The upward draft through the tubes is maintained by a fan mounted in the chimney outlet. Cold outside air, being carried to the combustion chamber, is passed around an upper portion of the heat exchanger tubes, thus preheating the combustion air and lowering the temperature of the exhaust gas within the tubes to the point that water vapor in the gas begins condensing out on the inner tube walls and running down them. Reaching the hotter, lower portions of the tube walls, the condensate again evaporates, rises, and recycles, scrubbing the exhaust gas of noxious pollutants as it recirculates. The condensate eventually runs out of the lower tube ends into a collecting chamber or drain pipe, and the scrubbed exhaust gas is drawn out of the chimney stack.

The previously described system utilizes a simple squirrel cage fan to induce a draft up the chimney. By replacing that fan with a unit which both induces a draft up the chimney, and removes the final bit of moisture from the exhaust gas, an improved pollutant scrubbing action and self-cleaning tube effect can be achieved. Heretofore, no device of which applicant is aware could achieve these effects.

SUMMARY OF THE INVENTION

The chimney stack exhaust treatment unit of the present invention comprises a standard squirrel cage fan and electric drive motor enclosed within a spherical globe which caps the chimney stack. As the fan is driven, it draws gas up the chimney and swirls it around the inner surface of the globe. The cold air surrounding the globe keeps the globe walls cool, providing a surface on which the remaining water vapor in the still relatively hot exhaust gas may condense. Drainage means at the bottom of the globe allow the condensate to flow back down the chimney stacks, providing a scrubbing function in the exhaust flow to remove pollutants. In the upper portion of the globe, a plurality of exhaust ports provides means of escape for cleaned exhaust gas.

An inner housing protects the fan motor from the corrosive action of exhaust gases. The inner housing is open along its lower portion to allow the fan to draw air downwardly through it, and includes an opening connected by means of a conduit to an opening in the outer globe, so that air drawn down through the inner housing is cool air from outside the outer globe.

The present invention thus provides a final treatment stage before exhausting gaseous products to the open air. It can be used effectively in home heating systems, as well as in commercial systems.

DESCRIPTION OF THE PREFERRED EMBODIMENT

Figure 1:
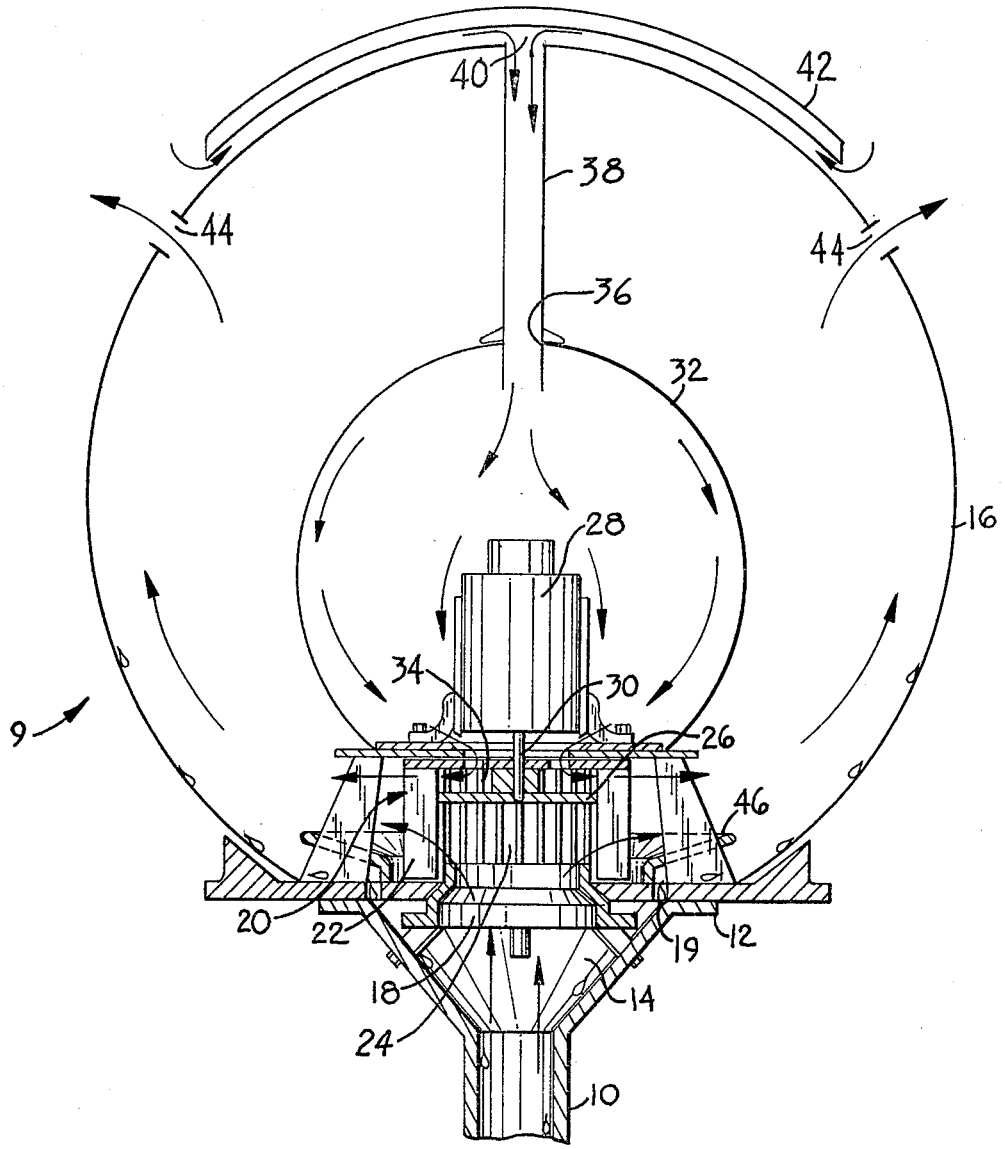
FIG. 1 is an enlarged sectional view of the chimney stack unit of the present invention.

Referring now to the drawings, FIG. 1 shown a chimney stack exhaust unit 9 for home use constructed in accordance with the present invention. Reference numeral 10 indicates a caustic resistant chimney stack pipe, constructed of material such as PVC. The walls of pipe 10 extend outwardly at the upper end of the pipe, terminating in annular flange 12, defining the mouth 14 of chimney pipe 10.

Mounted on flange 12, above mouth 14 is outer sphere 16, constructed of any suitable lightweight, caustic-resistant material—any one of a number of plastics would be appropriate. The lower portion of sphere 16 is provided with a lower opening 18 interfacing with chimney mouth 14, to provide fluid communication between the chimney stack and the interior of sphere 16. An annular drain opening 19 is also provided at the interface between sphere 16 and chimney pipe 10.

Mounted within sphere 16, immediately above openings 18 and 14, is a squirrel cage-type fan unit 20, the structure of which is well-known in the art. Unit 20 generally comprises a plurality of vertically oriented blades 22 which are fixed with respect to each other so as to generally define a hollow cylindrical unit. Unit 20 is mounted so that its axis of rotation is centered over chimney mouth 14. When squirrel cage fan 20 is rotated, air is drawn into the hollow core portion 24 of the unit from above and below, and forced radially outward between blades 22, as indicated by the air flow arrows in FIG. 1.

A solid plate 26 divides core 24 into upper and lower portions, the upper portion having approximately one fourth the size of the lower portion, whereby four fifths of the capacity of fan 20 is used to pull air upwardly through chimney 10, while one fifth of it capacity pulls air downwardly through the unit.

An electric motor 28 is mounted above fan unit 20, and rotates unit 20 by means of drive shaft 30. To protect motor 28 from the corrosive effects of the exhaust fumes being drawn into sphere 16, a second, inner sphere 32 is mounted so as to encase motor 28 and isolate it from the interior of sphere 16.

As is shown in FIG. 1, inner sphere 32 is provided with a lower opening 34 which is positioned above fan unit 20 so that the upper one fifth of fan 20 draws air downwardly from the interior of sphere 32. Sphere 32 is provided with an upper port 36, which is connected via conduit 38 with an inlet 40 in the upper portion of outer sphere 16, thus providing a pathway for cool, fresh, outside air to be drawn downwardly through sphere 32 to cool fan motor 28. A protective plate 42 keeps rain or snow from entering inlet 40. Also disposed about the upper portion of outer sphere 16 are a plurality of exhaust vents 44, through which treated exhaust air is exited.

An annular splashguard 46 rings the lower portion of squirrel cage fan 20 to funnel condensate into drain opening 19, and to protect fan blades 22 from this moisture.

Figure 2:
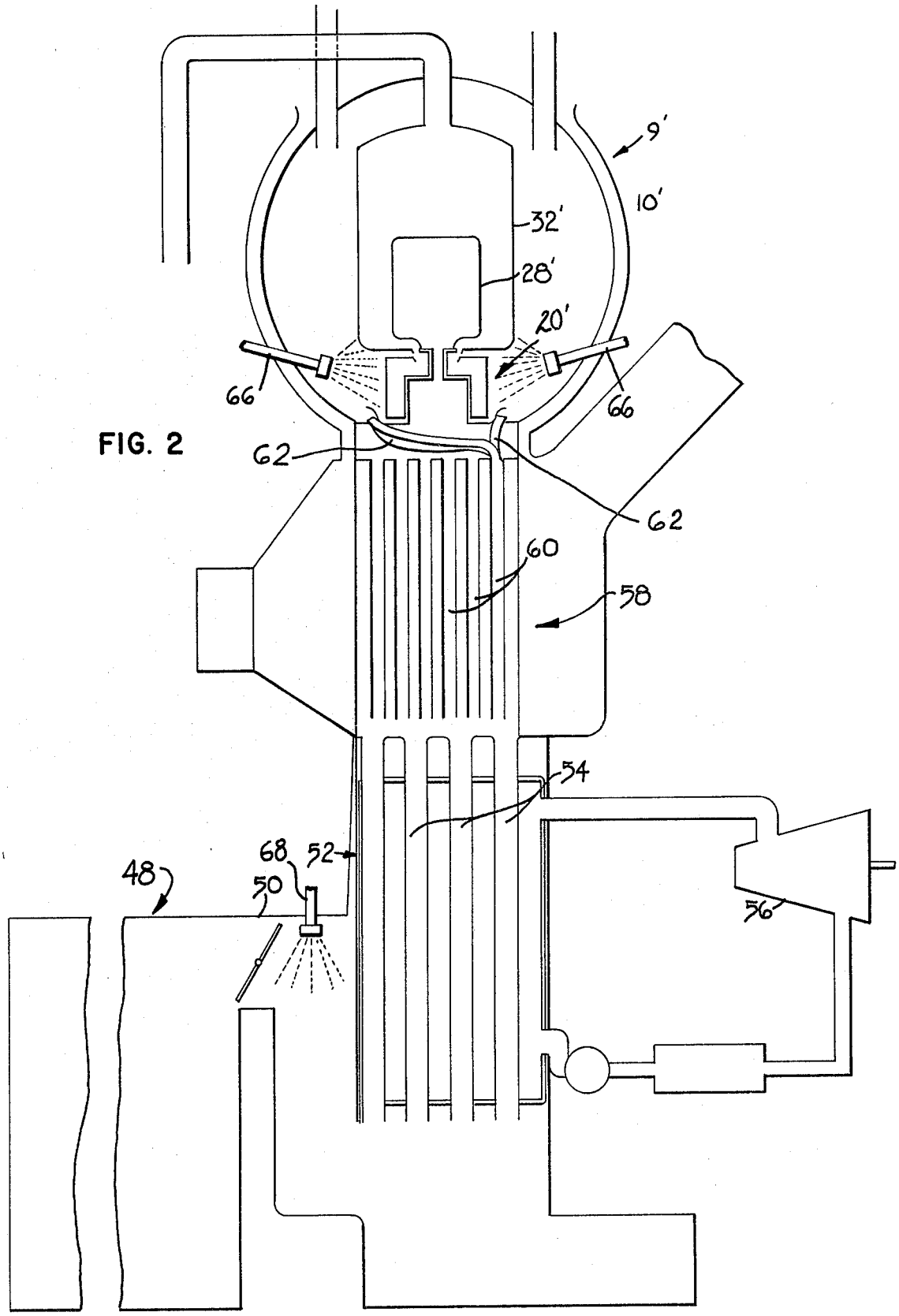
FIG. 2 is a view, partially schematic, showing the chimney stact unit of the present invention in combination with a heat exchanger and power plant.

FIG. 2 is a schematic representation of a commercial embodiment of a chimney stack exhaust unit of the present invention. In FIG. 2, numeral 9' refers to the chimney stack exhaust unit. Hot exhaust gases from a combustion type boiler, or like combustion unit 48 are exhausted via a duct 50 in to a first heat exchanger 52 comprising a plurality of vertically oriented tubes 54.

First heat exchanger 52 is similar to that disclosed in my previously mentioned, co-pending patent application, with the exception that, rather than passing cold outside air over tubes 54, they are enclosed in a water jacket, thus utilizing the hot exhaust gases to produce steam to power a turbine 56, for whatever purposes are desired. It is to be understood that the heat from the exhaust gases can be put to any desired work. The turbine arrangement is merely representative of what may be done once heat has been recaptured and translated into work.

Connected in series with first heat exchanger 52 is a second heat exchanger 58, which is also similar to that described in my co-pending patent application. In the case of FIG. 2, this heat exchanger passes cold outside air over a plurality of vertically oriented exhaust tubes 60, in order to preheat the air for combustion purposes, as was previously disclosed. Above second heat exchanger 58 is mounted chimney stack exhaust unit 9', which includes a double-walled outer sphere 10' enclosing a squirrel cage type fan unit, 20' and an isolation globe 32' enclosing a drive motor 28'.

In operation, hot exhaust gases enter a series of heat exchangers comprising vertically oriented tubes around which are passed cool air or water, and heat is extracted to perform various types of work. As the hot gases move up the tubes, and cool, moisture carried in that gas condenses out on the inside walls of the tubes and runs down them.

If the combustion fuel utilized in the burner system is oil, then there will be sufficient water vapor in the exhaust fumes passing upwardly into the stack exhaust unit 9' to build up the water vapor concentration therein and eventually to condense out the water vapor on the cool spherical housing walls. The condensate will run downwardly into the drain pipes 62 and thus subsequent condensation and redistillation in exhaust unit 9' and in tubes 60 is much like a "rain" effect, entraining any particulate matter, and scrubbing sulphurous gases from the exhaust fumes by the process of co-condensation.

In some systems, particularly commercial power plants, coal is burned rather than fuel oil, in which case less water vapor is present in the exhaust. To facilitate the final scrubbing stage in such systems, the stack exhaust unit 9' may be equipped with water spray nozzles 66 to provide a swirl of water within the unit to entrain the final bit of pollutant in the exhaust before passing it out of the system. Additionally, water may be injected into the system upstream of heat exchanger 54 via a spray nozzle 68, or similar means. Water injected into the flow of hot flue gases at this point will vaporize quickly and contribute to the "rain" effect within tubes 60.

Finally, the process of fractional distillation may be carried out at the upstream end of first heat exchanger 52 by installing a stepped series of domed, glass plates (not shown) below the mouths of heat exchanger tubes 54 in the stream of hot exhaust gas. The liquid run-off from tubes 54 falls on the hot glass plates, resulting in the boiling off of water and the progressive concentration of sulphuric, sulphurous and nitric acid which finds its way to a collection tank. Ammonia or ammonium hydroxide can be bubbled through this concentrated solution to produce liquid fertilizer.

What is claimed is:

1. A chimney stack exhaust unit comprising:

(a) a first, generally closed, spherical housing having a top portion and a bottom portion, said housing including a first opening in said bottom portion adapted to fit over a chimney stack mouth, plurality of second, outlet openings spaced annularly about said top portion of the housing, and a third opening in said top portion;

(b) a squirrel cage fan mounted generally horizontally within the first housing above and adjacent to the first opening, whereby rotation of the fan draws exhaust air upwardly through the stack and forces said exhaust air outwardly and upwardly in a swirling motion around the inside walls of the first housing;

(c) an electric motor mounted within the first housing above the fan, and means connecting said motor and the fan whereby the fan may be driven by the motor;

(d) a second, generally closed housing having top and bottom portions mounted within the first housing and enclosing the motor, said second housing including a blower opening in said bottom portion directly above the fan, and an upper opening in said top portion; and (e) a conduit extending between the upper opening in the second housing and the third opening in the first housing, whereby rotation of the fan draws air from outside the first housing into its third opening, downwardly through the conduit, into the second housing via its upper opening, and outwardly into the first housing via the lower opening in the second housing.

2. The chimney stack exhaust unit of claim 1 which further includes means for limiting the draft inducing capacity of the fan in such a way that a predetermined portion of the fan's capacity is utilized to draw cool air down through the second housing, and a second predetermined portion of the fans capacity is utilized to draw exhaust gases upwardly into the first housing.

3. The chimney stack exhaust unit of claim 2 which further includes baffle means mounted within the first housing adjacent the first opening for channeling condensate which runs down the housing walls away from the fan and down the first opening into the chimney stack.

4. The chimney stack exhaust unit of claim 3 which further includes means for preventing rain or snow from entering the first housing via the third opening therein.

5. The chimney stack exhaust unit of claim 4 wherein said first predetermined portion of the fan's draft inducing capacity is approximately 1/5 thereof and the second predetermined portion is approximately 4/5 of the total capacity of the fan.

6. A chimney stack exhaust unit, comprising:

(a) a first, generally closed, housing including a top portion, a bottom portion with a downwardly and inwardly sloping wall, and inside surfaces of said top and bottom portions, said bottom portion having a first opening adapted to fit over a chimney stack mouth, and said top portion having a plurality of second openings spaced thereabout and a third opening;

(b) a second, generally closed, housing mounted within said first housing and including a top portion with an upper opening and a bottom portion with a lower opening spaced from said first opening in said first housing;

(c) means for conducting air outside first housing from said third opening into said second housing through said upper opening; and (d) means for drawing exhaust air upwardly through the stack and forcing it outwardly and upwardly in a swirling motion around the inside surfaces of said first housing and for drawing air from outside said first housing through said third opening, downwardly through said conducting means into said second housing via said upper opening, and outwardly into said first housing through said bottom opening into confluence with the exhaust air.

7. The chimney stack exhaust unit of claim 6 wherein said drawing means comprises a motor driven squirrel cage type fan mounted generally horizontally within said first housing above and adjacent to said first opening and below and adjacent to said bottom opening in said second housing.

8. The chimney stack exhaust unit of claim 6 further comprising means for preventing rain or snow from entering said first housing through said third opening.

* * * * *